US012416237B1

(12) United States Patent
Zeng et al.

(10) Patent No.: US 12,416,237 B1
(45) Date of Patent: Sep. 16, 2025

(54) METHODS FOR GROUT INJECTION REPAIR AND WATER RETENTION IN GOAF

(71) Applicant: CHINA UNIVERSITY OF MINING AND TECHNOLOGY, BEIJING, Beijing (CN)

(72) Inventors: Yifan Zeng, Beijing (CN); Hao Li, Beijing (CN); Qiang Wu, Beijing (CN); Weihong Yang, Beijing (CN); Donghui Yang, Beijing (CN); Aoshuang Mei, Beijing (CN); Anqi Zhou, Beijing (CN)

(73) Assignee: CHINA UNIVERSITY OF MINING AND TECHNOLOGY, Beijing (CN)

( * ) Notice: Subject to any disclaimer, the term of this patent is extended or adjusted under 35 U.S.C. 154(b) by 0 days.

(21) Appl. No.: 19/232,933

(22) Filed: Jun. 10, 2025

(30) Foreign Application Priority Data

Jun. 21, 2024 (CN) ..... 202410809925.4

(51) Int. Cl.
*E21F 15/00* (2006.01)
*E21C 41/18* (2006.01)
*E21F 15/08* (2006.01)

(52) U.S. Cl.
CPC ..... *E21F 15/00* (2013.01); *E21C 41/18* (2013.01); *E21F 15/08* (2013.01)

(58) Field of Classification Search
CPC ..... E21F 15/00; E21F 15/08; E21C 41/18
See application file for complete search history.

(56) References Cited

U.S. PATENT DOCUMENTS 11,085,296 B2 * 8/2021 Ju ..... E21F 15/00
11,834,949 B2 * 12/2023 Guo ..... E21C 41/18

FOREIGN PATENT DOCUMENTS

| | | | |
|---|---|---|---|
| AU | 2019435042 | B2 | 10/2021 |
| CN | 203702244 | U | 7/2014 |
| CN | 108894727 | A | 11/2018 |
| CN | 115075872 | A | 9/2022 |
| CN | 115467639 | A | 12/2022 |

OTHER PUBLICATIONS

Second Office Action in Chinese Application No. 202410809925.4 mailed on Dec. 31, 2024, 7 pages.
Notification to Grant Patent Right for Invention in Chinese Application No. 202410809925.4 mailed on Apr. 3, 2025, 5 pages.
First Office Action in Chinese Application No. 202410809925.4 mailed on Nov. 7, 2024, 15 pages.

* cited by examiner

*Primary Examiner* — Janine M Kreck
(74) *Attorney, Agent, or Firm* — PORUS IP LLC

(57) ABSTRACT

Provided are a method for grout injection repair and water retention in a goaf, including: determining extraction information on the goaf and a coal seam, forming a barrier wall through performing a first grouting operation at a side of the goaf near the coal seam based on the extraction information, performing a second grouting operation to complete a grout injection repair from outside to inside in the goaf based on the extraction information. The first grouting pressure of the first grouting operation is less than the second grouting pressure of the second grouting operation.

4 Claims, 4 Drawing Sheets

METHODS FOR GROUT INJECTION REPAIR AND WATER RETENTION IN GOAF

CROSS-REFERENCE TO RELATED APPLICATIONS

This application claims priority to Chinese Patent Application No. 202410809925.4, filed on Jun. 21, 2024, the entire content of which is hereby incorporated by reference.

TECHNICAL FIELD

The present disclosure relates to the technical field of grout injection repair, and in particular, to a method of grout injection repair and water retention in a goaf.

BACKGROUND

Coal is an important natural resource, with the innovation of coal mining technology, the scale and intensity of mining are increasing. Especially in the areas with good endowment conditions, simple geology, and large coal reserves, with the accumulation of mining time, a large number of goafs remains. Groundwater along the mining fissure continuously gathered to the goaf, with the accumulation of water in the goaf, the seepage water pressure is constantly increasing, the coal pillar in the role of repeated disturbance of the mining pressure is constantly weakening, triggering the water inrush hazard at the working face, which not only causes the waste of groundwater, but also seriously threatens the life and property safety of the site staff.

Currently, grouting management is the most commonly used technical manner to maintain the stability of the aquifer in the goaf, utilizing the mobility or pumpability of slurry, pumping it through the drilling holes to the area of the surge water, and effectively repairing the aquifer. However, the existing manner of grout injection repair neglects the impact on the coal pillar around the goaf, and the grouting process is easy to damage a coal seam, causing harm, and the slurry may be accompanied by the loss of moving water leading to a large amount of consumption.

There is therefore an urgent need for a method for grout injection repair and water retention in a goaf, which can avoid the water inrush hazard at the working face by the destruction of coal pillars through the formation of a barrier wall between the goaf and the coal seam to improve safety and reduce the amount of slurry loss in the subsequent grouting operation and improve the effectiveness of grouting.

SUMMARY

In view of the above, the purpose of the present disclosure is to propose a method for grout injection repair and water retention in a goaf to solve the above technical problems.

One or more embodiments of the present disclosure provide a method for grout injection repair and water retention in a goaf, comprising: determining extraction information on the goaf and a coal seam;

forming a barrier wall through performing a first grouting operation at a side of the goaf near the coal seam based on the extraction information, including: determining a first cross-sectional pattern of the goaf based on the extraction information; forming, starting from the coal seam near a corner of the first cross-sectional pattern, a first trajectory line through extending along an edge of the first cross-sectional pattern into the goaf; wherein first trajectory lines corresponding to each corner of the first cross-sectional pattern connect to each other to form a first grouting pattern; and performing the first grouting operation according to the first grouting pattern to form the barrier wall, including: controlling, at a ground area corresponding to a starting point of each of the first trajectory lines of the first grouting pattern, a drilling device to perform vertical drilling based on a vertical drilling parameter to obtain a plurality of first grouting holes; for each of the plurality of first grouting holes, controlling the drilling device to perform horizontal drilling along a first trajectory line corresponding to the first grouting hole based on a horizontal drilling parameter to obtain a plurality of first branch holes; controlling a plurality of low-pressure grouting pumps to perform the first grouting operation on each of the plurality of first branch holes based on a first grouting pressure to form the barrier wall; wherein a distance between the first trajectory line and an adjacent edge of the first cross-sectional pattern is less than or equal to a target grouting radius; and a distance between a starting point of the first trajectory line and an adjacent edge of the first cross-sectional pattern is greater than or equal to the target grouting radius;

performing a second grouting operation to complete a grout injection repair from outside to inside in the goaf based on the extraction information, including: determining a second cross-sectional pattern of the barrier wall and a lowest point of a water level in the goaf based on the extraction information; forming, starting from any corner of the second cross-sectional pattern, a second grouting pattern through spirally extending along an edge of the second cross-sectional pattern toward the lowest point of the water level; and performing the second grouting operation according to the second grouting pattern to complete the grout injection repair, including: controlling, at a ground area corresponding to a corner of the second grouting pattern, the drilling device to perform vertical drilling based on the vertical drilling parameter to obtain a plurality of second grouting holes; controlling the drilling device to perform horizontal drilling on the plurality of second grouting holes along at least one second trajectory line based on the horizontal drilling parameter to obtain a plurality of second branch holes; controlling a plurality of high-pressure grouting pumps to perform the second grouting operation one by one on the plurality of second branch holes from outside to inside in the goaf based on a second grouting pressure to complete the grout injection repair; wherein the first grouting pressure of the first grouting operation is less than the second grouting pressure of the second grouting operation; the second grouting pattern includes a plurality of second trajectory lines connected end to end, and a distance between a plurality of second trajectory lines parallel to a same edge of the second cross-sectional pattern is less than or equal to two times the target grouting radius; and a distance between a second trajectory line located at an outermost portion of the second grouting pattern and an adjacent edge of the second cross-sectional pattern is less than or equal to the target grouting radius.

BRIEF DESCRIPTION OF THE DRAWINGS

In order to more clearly illustrate the technical solutions in the present disclosure or the related technology, the accompanying drawings that need to be used in the descriptions of the embodiments or the related technology will be briefly introduced in the following, and it will be obvious that the accompanying drawings in the following descriptions are only embodiments of the present disclosure, and that for those of ordinary skill in the art, other drawings can be obtained based on these drawings without creative labor.

Figure 1:
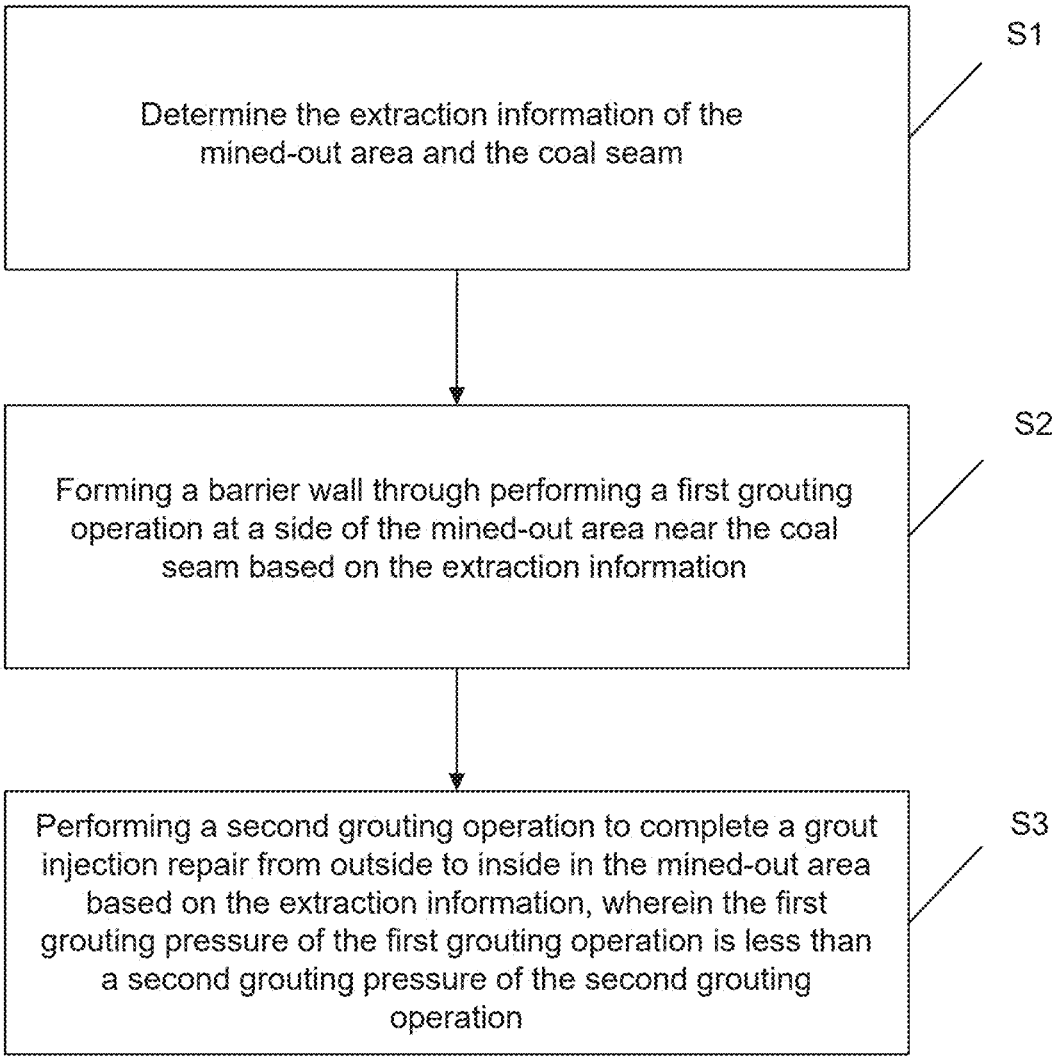
FIG. 1 is a flow diagram of a method for grout injection repair and water retention in a goaf according to some embodiments of the present disclosure.

Figure markings: 1, grouting hole; 2, branch hole; 3, coal seam; 4, collapsed zone; 5, goaf; 6, barrier wall; 7, first trajectory line; 8, first grouting hole; 9, second trajectory line; 10, second grouting hole.

DETAILED DESCRIPTION

In order to make the purpose, technical solution and advantages of the present disclosure more clearly understood, the present disclosure is described in further detail below in combination with specific embodiments and with reference to the accompanying drawings.

It should be noted that, unless otherwise defined, technical terms or scientific terms used in the embodiments of the present disclosure should have the ordinary meaning as understood by a person of ordinary skill in the field to which the present disclosure belongs. The use of the terms "first", "second" or the like in the embodiments of the present disclosure does not indicate any order, number, or importance, but are merely used to distinguish between different components. The words "includes" or "comprises" or the like mean that the components or objects appearing before the word "includes" or "comprises" encompass the components or objects appearing after the word "includes" or "comprises" and its equivalents, and does not exclude other components or objects. The terms "connected" or "connection" or the like are not limited to physical or mechanical connections, but may include electrical connections, whether direct or indirect. "Up", "Down", "Left", "Right", etc., are only used to represent relative positional relationships, and when the absolute position of the object being described is changed, then that relative positional relationship may change accordingly.

Coal is an essential natural resource. With continuous innovations in coal mining technology, the scale and intensity of extraction operations have progressively increased, particularly in regions possessing favorable coal seam conditions, straightforward geological structures, and abundant coal reserves. Over extended periods of mining activity, substantial goafs have been formed in these locations. Groundwater continuously collects into the goaf along mining-induced fractures. As the amount of water in the goaf continues to accumulate, the seepage water pressure increases, causing the coal pillar to weaken under the repeated disturbance of mine pressure. This leads to the risk of sudden water inrush in the working face, which not only results in the waste of groundwater but also poses a serious threat to the life and property safety of on-site personnel. The risk of sudden water inrush in the working face may be the sudden influx of groundwater or water accumulation into the underground working face during the coal mining process.

Currently, grouting treatment is the most commonly used technical method for maintaining the stability of aquifers in goaf areas. It utilizes the flowability or pumpability of the grout, which is pumped through drilled holes to the area prone to water inrush, allowing for effective repair of the aquifer. However, existing grouting repair manners neglect the impact on the surrounding coal pillars in the goaf area, making it easy to damage the coal seam during the grouting process, which poses risks. Additionally, the grout may lead to significant loss due to dynamic water flow, highlighting the urgent need for a water-preserving grouting repair method for goafs.

Hereinafter, the technical solutions of the present disclosure are described in detail through specific embodiments and in conjunction with FIG. 1 to FIG. 4.

FIG. 1 is a flow diagram of a method for grout injection repair and water retention in a goaf according to some embodiments of the present disclosure.

In some embodiments, the method for grout injection repair and water retention in a goaf may be performed by a processor. The processor may include a central processing unit (CPU), an application-specific integrated circuit (ASIC), an application-specific instruction set processor (ASIP), a graphics processing unit (GPU), a physics processing unit (PPU), a digital signal processor (DSP), a field-programmable gate array (FPGA), a programmable logic device (PLD), a microprocessor, etc., or any combination thereof.

In some embodiments, a memory may also be integrated into the processor. The memory may store a plurality of pieces of data from a grout injection repair process, such as a first grouting pressure from historical data. The memory may include a removable memory, etc., or any combination thereof.

Some embodiments of the present disclosure provide the method for grout injection repair and water retention in a goaf, as shown in FIG. 1, includes the steps of:

S1, determining extraction information of the goaf and a coal seam.

The goaf refers to an area of hollow or loose collapse formed underground after mineral resources (e.g., coal, etc.) have been mined. The coal seam refers to an area of coal to be mined.

The extraction information refers to information related to the extraction of the coal seam and the goaf. In some embodiments, the extraction information may include location information of a goaf 5 and a coal seam 3, and distribution information of isowater level lines in a mining area.

The mining area refers to an operational area for mining coal, including the goaf, the coal seam, etc. The distribution information of isowater level lines may reflect regions or locations in the goaf with the same water level elevation.

In some embodiments, the processor may access the extraction information through a memory, etc. The extraction information may be determined by a technician and uploaded to the memory based on hydrologic history information, on-site surveys, etc.

S2, forming a barrier wall through performing a first grouting operation at a side of the goaf near the coal seam based on the extraction information.

In some embodiments, after determining the location information of the goaf 5 and the coal seam 3, the processor may determine a dividing interface between the goaf 5 and the coal seam 3, control a plurality of low-pressure grouting pumps to perform the first grouting operation to form a barrier wall 6 at a side of the goaf 5 near the coal seam 3. The first grouting operation refers to an operation of directly grouting the side of the goaf 5 near the coal seam 3.

Figure 4:
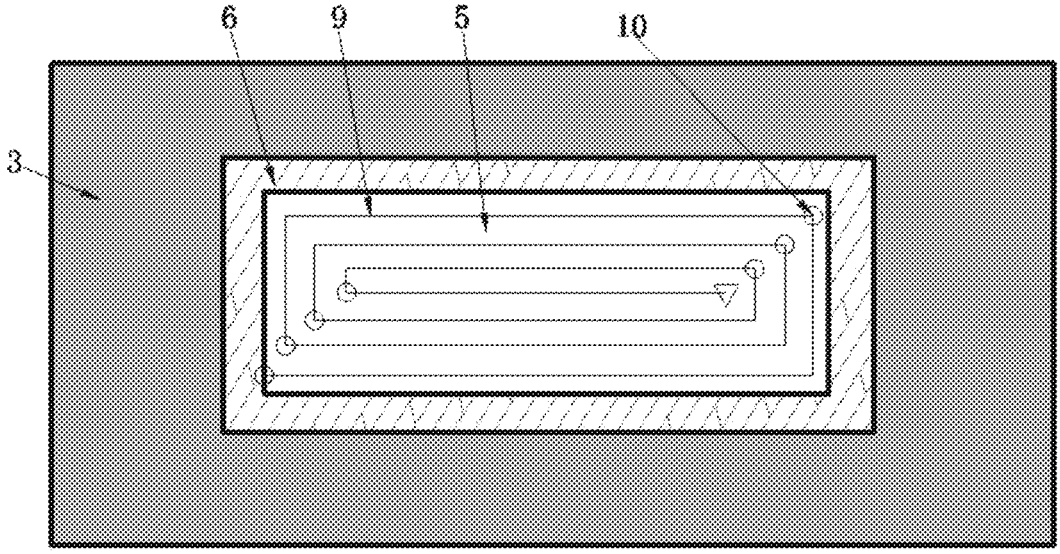
FIG. 4 is a schematic diagram of a transverse cross-section of a second grouting operation in a goaf according to some embodiments of the present disclosure.

FIG. 4 is a schematic diagram of a transverse cross-section of a second grouting operation in a goaf according to some embodiments of the present disclosure.

In some embodiments, as shown in FIG. 4, by forming the barrier wall 6 between the goaf 5 and the coal seam 3, the coal pillar can be protected from damage to the coal pillar that induces a water gushing accident at the working face (also referred to as the water inrush hazard at the working face), thereby improving safety, reducing an amount of slurry loss in a subsequent second grouting operation, and improving the grouting effect.

The coal pillar refers to a part of an unmined coal seam or rock body retained during the mining process to maintain the stability of the goaf and block groundwater, etc. The coal pillar, based on its own strength and stability, supports the pressure of an overlying rock layer, which avoids the occurrence of a large-scale collapse of the goaf or the subsidence of the ground surface, and at the same time, plays the role of isolation and protection.

Because of the high grouting pressure during conventional ground grouting, it is easy to damage water-resistant coal pillars at an edge of the goaf 5. In some embodiments, by grouting and filling the edge of the goaf 5, the barrier wall 6 is formed on one side of the goaf 5, and the barrier wall 6 is used to resist the pressure formed by the subsequent large-scale grouting to reduce coal pillar damage. Compared with the traditional grouting manner, the above grouting manner is more reliable, and it avoids the water inrush hazard at the working face induced by the destruction of the coal pillar caused by the grouting.

S3, performing a second grouting operation to complete a grout injection repair from outside to inside in the goaf based on the extraction information, wherein the first grouting pressure of the first grouting operation is less than a second grouting pressure of the second grouting operation.

In some embodiments, after determining the distribution information of isowater level lines in the goaf 5, the processor may control a plurality of high-pressure grouting pumps to gradually perform the second grouting operation in the goaf 5 from an area with a high water level to a low water level, i.e., perform a grouting operation from outside to inside. The second grouting operation may play a guiding role in gradually squeezing the surging water of the goaf 5 to flow inward and return to the aquifer, thus avoiding the surging water from spreading outwardly to the goaf 5, thereby reducing the amount of slurry, improving the effect of the grouting, effectively sealing the fissures, effectively reducing the loss of shallow water resources, maintaining the stability of the aquifer, and also avoiding extruding and destroying the coal pillar, which improves safety.

In some embodiments, the first grouting pressure corresponding to the first grouting operation is less than the second grouting pressure corresponding to the second grouting operation.

In some embodiments, the first grouting pressure of the first grouting operation is relatively small, for example, the first grouting pressure is less than a hydrostatic pressure at a grouting region corresponding to the first grouting operation, to avoid destroying the coal seam 3. At the grouting region, because of the large rock gaps, a lower grouting pressure can achieve the effect of infiltration grouting. The second grouting pressure of the second grouting operation is relatively large, for example, the second grouting pressure is two to three times a hydrostatic pressure at a grouting region corresponding to the second grouting operation, so as to achieve the effect of fracture diffusion grouting, and to squeeze the surge water flow. The infiltration grouting may be a technique for reinforcing the goaf by filling an existing fissure with high-pressure grout. The fracture diffusion grouting may be a technique for artificially creating fissures and filling them with high-pressure grouting to reinforce the goaf.

The method for grout injection repair and water retention in the goaf in some embodiments of the present disclosure is simple and convenient, and it can effectively seal post-mining fissures, ensure stability of the working face, reduce maintenance costs, and reduce shallow water loss. The method is mainly targeted at the goaf 5 where the amount of water accumulation is large, the speed of water accumulation is fast, and the threat to the production of the subsequent working face is large, which can reduce the risk of water damage in the goaf 5, protect the groundwater resources, and can reduce water loss waste in the overlying rock layer of the coal seam 3, thus reducing resource waste and environmental pollution.

In some embodiments, step S1 is followed by:

S201, selecting a plurality of points in a ground area corresponding to the goaf for drilling to obtain a plurality of test holes.

In some embodiments, the processor may select a preset number of points equally spaced or randomly in the ground area corresponding to the edge of the goaf 5, and control a drilling device to drill to obtain the plurality of test holes. The preset number may be at least 3.

S202, grouting each of the plurality of test holes and obtaining a slurry diffusion radius.

In some embodiments, the processor may control the plurality of low-pressure grouting pumps to grout each of the test holes, and the grouting may be performed with either a parameter setting for the first grouting operation or a parameter setting for the second grouting operation. After grouting, the processor may obtain the slurry diffusion radius for each test hole through input from a technician, etc. The technician may take a sample to measure the slurry diffusion radius for each test hole.

The slurry diffusion radius may be a radius of slurry diffusion from the center of the grouting region to the surrounding strata.

S203, selecting a smallest slurry diffusion radius as a target grouting radius.

The target grouting radius refers to a finalized slurry diffusion radius. In some embodiments, the processor may select the smallest slurry diffusion radius as the target grouting radius, which facilitates the subsequent design of the grouting trajectory line with the target grouting radius to ensure the grouting effect.

In some embodiments, step S2 includes:

S211, determining a first cross-sectional pattern of the goaf based on the extraction information.

Figure 3:
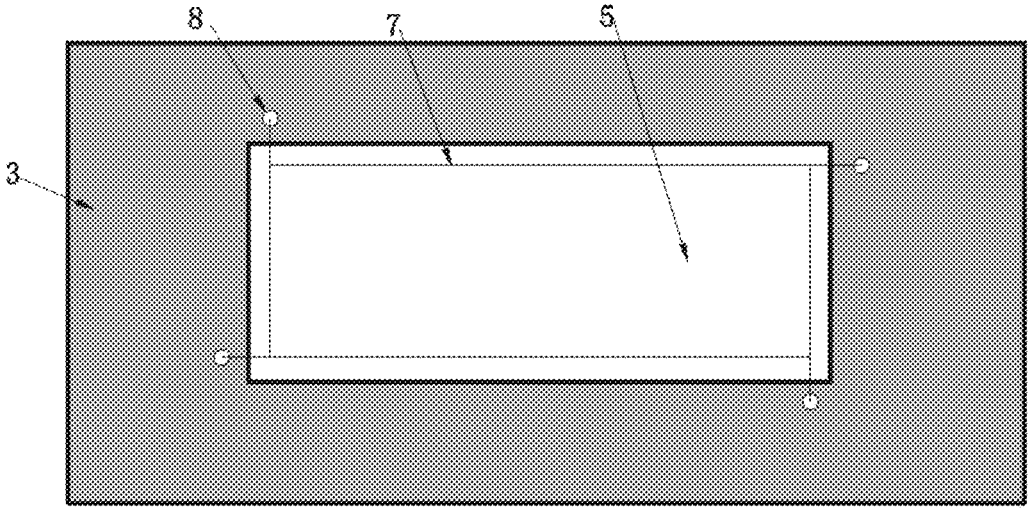
FIG. 3 is a schematic diagram of a transverse cross-section of a first grouting operation in a goaf according to some embodiments of the present disclosure.

FIG. 3 is a schematic diagram of a transverse cross-section of a first grouting operation in a goaf according to some embodiments of the present disclosure.

In some embodiments, the processor may determine the first cross-sectional pattern of the goaf 5 based on the location information of the coal seam 3 and the goaf 5, as shown in FIG. 3, the first cross-sectional pattern of the goaf 5 may be a rectangle, etc.

S212, forming, starting from the coal seam near a corner of the first cross-sectional pattern, a first trajectory line through extending along an edge of the first cross-sectional pattern into the goaf; wherein first trajectory lines corresponding to each corner of the first cross-sectional pattern connect to each other to form a first grouting pattern.

In some embodiments, the processor forms, starting from the coal seam 3 near a corner of the first cross-sectional pattern, a plurality of first trajectory lines through extending along an edge of the first cross-sectional pattern into the goaf 5, as shown in FIG. 3, where the circles at the four corners of the goaf 5 are shown as starting points. One first trajectory line extends along the edge of the first cross-sectional pattern from the starting point, i.e., along the long or short edge of the rectangle, until the first trajectory line meets with another first trajectory line in the goaf 5. As shown in FIG. 3, four first trajectory lines in total are formed, and the four first trajectory lines meet each other end to end to form the first grouting pattern, and the first grouting pattern is a rectangle with extended edges at the corners.

S213, performing the first grouting operation according to the first grouting pattern to form the barrier wall.

In some embodiments, the processor controls the plurality of low-pressure grouting pumps to perform the first grouting operation based on the first grouting pressure according to the first grouting pattern, i.e., grouting along each of the first trajectory lines, which can result in dense grouting of the edges and corners of the first cross-sectional pattern. Forming a closed barrier wall 6 as shown in FIG. 4 ensures a protective effect on the coal pillars around the goaf 5.

Exemplarily, the first grouting operation may be performed using 0.8 times the hydrostatic pressure at the grouting region corresponding to the first grouting operation as the first grouting pressure. When the grouting pressure is stabilized and the grouting is continued for 3 h, the grouting is stopped, and a waiting period of 12 h is carried out to stabilize the slurry solidified skeleton before the subsequent second grouting operation.

In some embodiments, a spacing between each first trajectory line and an adjacent edge of the first cross-sectional pattern (i.e., a long or short edge of the rectangle that is proximate and parallel to the first trajectory line) is less than or equal to the target grouting radius. A spacing between the starting point of each first trajectory line and an adjacent edge of the first cross-sectional pattern (i.e., the long or short edge of the rectangle near the starting point of the first trajectory line) is greater than or equal to the target grouting radius.

The target grouting radius is the aforementioned minimum slurry diffusion radius. In some embodiments, the spacing between the first trajectory line and the adjacent edge of the first cross-sectional pattern is less than or equal to the target grouting radius. As shown in FIG. 3, the spacing between the first trajectory line disposed transversely at the lowermost part and the lower bottom edge of the first cross-sectional pattern is less than or equal to the target grouting radius to ensure that, after the first grouting operation, slurry covers the space between the first trajectory line and the lower bottom edge to form a complete barrier wall 6, ensuring the stability of the working surface and the subsequent grouting effect.

In some embodiments, the spacing between the starting point of the first trajectory line and the adjacent edge of the first cross-sectional pattern is greater than or equal to the target grouting radius. As shown in FIG. 3, the starting point of the first trajectory line disposed transversely at the lowermost part is the position of the circle at the lower left corner of FIG. 3, and the spacing between the starting point and a short edge on the left side of the first cross-sectional pattern is greater than or equal to the target grouting radius, so that drilling and grouting at this starting point can reduce the damage of the slurry to the edge of the coal seam 3.

In some embodiments, step S213 includes:

S2131, controlling, at a ground area corresponding to each of the first trajectory lines of the first grouting pattern, the drilling device to perform vertical drilling based on a vertical drilling parameter to obtain a plurality of first grouting holes (e.g., a first grouting hole 8, etc.).

In some embodiments, the processor may control the drilling device to perform equally spaced vertical drilling holes based on the vertical drilling parameter to obtain the plurality of first grouting holes. A spacing between any two adjacent first grouting holes is less than two times the target grouting radius.

The vertical drilling parameter may be preset based on historical experience, including an opening diameter (e.g., 311 mm), a drilling depth (e.g., 10 m), etc.

S2132, performing the first grouting operation on each of the plurality of first grouting holes to form the barrier wall.

In some embodiments, as shown in FIG. 3, the plurality of first grouting holes are provided at equal spacing along a ground area corresponding to a first trajectory line below the first grouting pattern, and a spacing of any two adjacent first grouting holes is 1.5 times the target grouting radius, such that after grouting each of the first grouting holes, a continuous barrier wall 6 may be formed along the first trajectory line. The closed barrier wall 6 is formed after grouting along each of the first trajectory lines.

In some embodiments, step S213 may further include:

S2131, controlling, at a ground area corresponding to a starting point of each of the first trajectory lines of the first grouting pattern, the drilling device to perform vertical drilling based on the vertical drilling parameter to obtain the plurality of first grouting holes.

S2132, for each of the plurality of first grouting holes, controlling the drilling device to perform horizontal drilling along the first trajectory line corresponding to the first grouting hole based on a horizontal drilling parameter to obtain a plurality of first branch holes.

The horizontal drilling parameter may be preset based on historical experience, including the opening diameter and the extended location of the horizontal drilling hole, etc.

S2133, controlling the plurality of low-pressure grouting pumps to perform the first grouting operation on each of the plurality of first branch holes based on the first grouting pressure to form the barrier wall.

In some embodiments, as shown in FIG. 3, the first grouting hole is obtained by performing vertical drilling in a ground area corresponding to a starting point of the first trajectory line below the first grouting pattern, and then, by beveling the first grouting hole, to the first branch hole is obtained by performing horizontal drilling on the first grouting hole along the first trajectory line.

Figure 2:
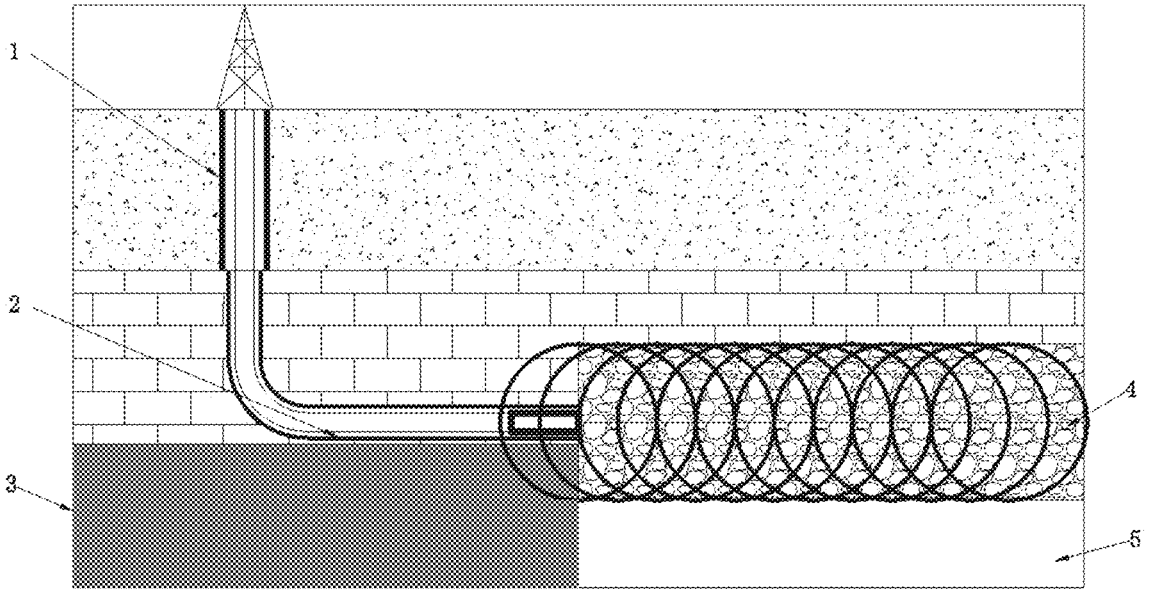
FIG. 2 is a schematic diagram of a longitudinal cross-section of grouting in a goaf according to some embodiments of the present disclosure.

FIG. 2 is a schematic diagram of a longitudinal cross-section of grouting in a goaf according to some embodiments of the present disclosure.

For example, as shown in FIG. 2, a first grouting operation is performed through a first grouting hole (e.g., a grouting hole 1) and a first branch hole (e.g., a branch hole 2), which may form a continuous barrier wall along a first trajectory line. The closed barrier wall is formed after grouting along each first trajectory line.

Compared to the aforementioned manner of setting the plurality of first grouting holes in the same first trajectory, this manner can reduce a count of drilling holes, greatly improve the efficiency of grouting, cause little damage to the formation, and ensure the quality of grouting.

In some embodiments, the processor performs the second grouting operation to complete the grout injection repair from outside to inside in the goaf based on the extraction information, including:

S311, determining a second cross-sectional pattern of the barrier wall and a lowest point of a water level in the goaf based on the extraction information.

In some embodiments, the processor may determine the second cross-sectional pattern of the barrier wall 6 based on the location information of the coal seam 3 and the goaf 5, the plurality of first trajectory lines, and the slurry diffusion radius. As shown in FIG. 4, the cross-sectional pattern of the barrier wall 6 is rectangular. The processor may determine the lowest point of the water level within the goaf 5 (as shown by the triangular position in FIG. 4) based on the distribution information of isowater level lines.

S312, forming, starting from any corner of the second cross-sectional pattern, a second grouting pattern through spirally extending along an edge of the second cross-sectional pattern toward the lowest point of the water level.

In some embodiments, the processor may form the second grouting pattern by starting at any corner of the second cross-sectional pattern and spiraling along the edge of the second cross-sectional pattern toward the lowest point of the water level. As shown in FIG. 4, the circle at the lower left corner in FIG. 4 is at the corner of the second cross-sectional pattern, which is the starting point. From the starting point along the corner of the second cross-sectional pattern, the inward spiral extends until the lowest point of the water level, forming the second grouting pattern in the form of a U-shape. As shown in FIG. 4, the second grouting pattern includes a plurality of second trajectory lines (e.g., a second trajectory line 9, etc.) connected head to end, and each of the plurality of second trajectory lines is parallel to one edge of the second cross-sectional pattern.

S313, performing the second grouting operation according to the second grouting pattern to complete the grout injection repair.

In some embodiments, the processor may control the plurality of high-pressure grouting pumps following the second grouting pattern to perform the second grouting operation based on the second grouting pressure, i.e., grouting from outside to inside along each of the second trajectory lines. The second grouting operation may play a guiding role, gradually squeezing the gushing water in the goaf 5 to flow inward and return to the aquifer, avoiding spreading outward to the goaf 5, thus reducing the amount of slurry, improving the effect of grouting, effectively blocking the fissure, and effectively reducing shallow water, and maintaining the stability of the aquifer.

Exemplarily, the second grouting operation may include grouting using three times the hydrostatic pressure at the grouting region corresponding to the second grouting operation. When the grouting pressure is stabilized and the grouting is continued for 3 hours, the grouting is stopped and a 12-hour waiting period is carried out for stabilizing the slurry solidified skeleton.

In some embodiments, the spacing of the second trajectory lines parallel to the same edge of the second cross-sectional pattern is less than or equal to two times the target grouting radius. The spacing between the second trajectory line located on the outermost side of the second grouting pattern and an adjacent edge of the second cross-sectional pattern (i.e., the long or short edge of the second trajectory line near the outermost side of the second cross-sectional pattern) is less than or equal to the target grouting radius.

In some embodiments, the spacing of second trajectory lines parallel to the same edge of the second cross-sectional pattern is less than or equal to two times the target grouting radius. As shown in FIG. 4, the plurality of second trajectory lines set transversely are spaced at a spacing of 1.5 times the target grouting radius so that, after the second grouting operation is performed, the slurry of the adjacent second trajectory lines overlap with each other, which can effectively fill the cracks and form a stable skeleton structure.

In some embodiments, the spacing between the second trajectory line located at the outermost side of the second grouting pattern and the adjacent edge of the second cross-sectional pattern is less than or equal to the target grouting radius. As shown in FIG. 4, the spacing of a second trajectory line disposed transversely at the lowermost part from the lowermost long edge of the second cross-sectional pattern is less than or equal to the target grouting radius such that the grout can fill the area between the second trajectory line disposed transversely at the lowermost part and the region between the barrier wall 6 to ensure grouting effectiveness.

In some embodiments, step S313 includes:

S3131, controlling, at a ground area corresponding to each of the second trajectory lines of the second grouting pattern, the drilling device to perform vertical drilling based on the vertical drilling parameter to obtain a plurality of second grouting holes (e.g., a second grouting hole 10, etc.). A spacing of any two adjacent second grouting holes is less than two times the target grouting radius.

S3132, performing the second grouting operation on each of the plurality of second grouting holes to form the barrier wall.

In some embodiments, as shown in FIG. 4, the plurality of second grouting holes are set at an equal spacing along a ground area corresponding to a second trajectory line at the lowermost part of the second grouting pattern, and a spacing of any two adjacent second grouting holes is 1.5 times the target grouting radius, so that after grouting each second grouting hole, the fissures in and around the second trajectory line can be sealed.

In some embodiments, step S313 may further include:

S3131, controlling, at a ground area corresponding to a corner of the second grouting pattern, the drilling device to perform vertical drilling based on the vertical drilling parameter to obtain the plurality of second grouting holes.

S3132, controlling the drilling device to perform horizontal drilling on the plurality of second grouting holes along at least one second trajectory line based on the horizontal drilling parameter to obtain a plurality of second branch holes.

S3133, controlling the plurality of high-pressure grouting pumps to perform the second grouting operation one by one on the plurality of second branch holes from outside to inside in the goaf based on the second grouting pressure to complete the grout injection repair.

In some embodiments, vertical drilling is performed on a ground area corresponding to each corner of the second grouting pattern to obtain the plurality of second grouting holes, and then by beveling the second grouting holes, the plurality of second branch holes are obtained by performing horizontal drilling on each second grouting hole along a second trajectory line. The second grouting operation is performed on the plurality of second branch holes from outside to inside to achieve grout injection repair.

In some embodiments, as shown in FIG. 4, the plurality of second grouting holes are obtained by performing vertical drilling in the ground area corresponding to a portion of corners of the second grouting pattern (e.g., the second grouting hole 10, etc., at the circular location in FIG. 4), and two adjacent second grouting holes along the second grouting pattern are spaced apart from each other by a corner. By slanting the second grouting holes, and performing horizontal drilling on each of the second grouting holes along each of the two perpendicular second trajectory lines, the plurality of second branch holes are obtained, and the second grouting operation is performed on the plurality of second branch holes from outside to inside to realize the grout injection repair. Compared to the aforementioned setting in which one second grouting hole corresponds to only one second trajectory line, this manner can further reduce the count of drilled holes and greatly improve the efficiency of grouting according to some embodiments of the present disclosure.

This manner, compared to the aforementioned manner of setting the plurality of second grouting holes in the same second trajectory line, can reduce the count of drilled holes, greatly improve the efficiency of the grouting, cause little damage to the formation, and ensure the quality of the grouting according to some embodiments of the present disclosure.

Exemplary processes for applying a method for grout injection repair and water retention in a goaf may include:

Operation 1: conducting a collapsed zone morphology and aquifer water level probe.

The collapse zone refers to a loose and fragmented zone formed by the rupture or collapse of the roof rock layer due to the loss of support after coal mining. In some embodiments, probing of the morphology of the collapse zone may be determined by comparison using theoretical calculations and drilling probing. The height of the collapse zone may be calculated according to the following equation (1):

$$H_k = \frac{100 \sum M}{4.7 \sum M + 19} \pm 2.2 \tag{1}$$

wherein, $H_k$ is the height of the collapse zone, and $\Sigma M$ is the cumulative mining height of the coal seam. The cumulative mining height of the coal seam refers to a total height of the cumulatively mined coal seam.

In some embodiments, the probe holes for drilling probing may be arranged directly above the goaf of working face at a frequency of 1 probe hole per 10,000 $m^2$, and the probe holes at the edges of the goaf may not be less than 50% of the total count of probe holes. The height of the collapse zone is comprehensively analyzed by drilling coring, analysis of leakage of drilling, and acquisition of drilling TV images, such as inversion of coring results, and void or porosity analysis of the coring specimens.

In some embodiments, aquifer water level probing may be performed by providing water level long view holes in the construction aquifer. Depending on the count of major aquifers in the roof slab, the water level long view holes are set up per aquifer at a frequency of 1 water level long view hole per 10,000 $m^2$. Drawing exploration lines and perform cross-construction at the intersections of the exploration lines. For example, at a certain intersection, the water-level observation hole is constructed within the strata of the Quaternary system, while the adjacent water-level observation hole at that intersection is constructed to the weathered bedrock. In addition, the water level long view holes for each aquifer are evenly spaced within the construction area, thus determining the extraction information for the goaf and the coal seam.

Operation 2: determining the starting point of the first trajectory line according to the morphology of the collapse zone in the exposed goaf and the design of the first construction of the barrier wall. The starting point may be disposed on the side of the goaf and at a distance of not less than 10 meters from the coal pillar (the target grouting radius is 10 meters) and at a distance of less than 1 meter from the top of the collapse zone. According to the topography, geomorphology, and lithology of the rock formation in the construction area, the operator evaluates the construction difficulty and economic cost, and chooses a suitable starting point for the trajectory.

Because the process of establishing the barrier wall needs to protect the coal pillar, to avoid excessive grouting pressure to destroy the water-resistant coal pillar, the short-distance and large-curvature directional drilling process is adopted, and the grouting pressure is less than the water pressure at the grouting region, and the grouting is done cumulatively until the barrier wall is formed at the edge of the goaf. After determining the location of the first grouting hole, drilling starts from the ground, and the opening location is located on the directional drilling axis of the first grouting hole, and the distance between the opening location and the edge of the collapse zone is more than 20 meters. The first drilling is performed with an opening diameter of 311 mm, advanced until 10 meters into the intact bedrock, and then a 273×10 mm casing is run. The annular gap outside the casing is cemented with a 0.6:1 single-fluid cement slurry. The first drilling is performed with an opening diameter of 133 mm. Deviated drilling commenced 20 meters above the top of the collapse zone, and directional drilling is performed until reaching the starting point of the first trajectory line. A 177.8 mm steel pipe is then run and cemented.

If a large leakage of drilling fluid is encountered during early drilling (distance from the collapse zone is greater than 10 m), the wall may be shored up by quantitative grouting and addition of quicklime. When the drilling is close to the collapse zone (the distance from the collapse zone is less than 10 m), leakage of a large amount of drilling fluid occurs, and the filling operation starts immediately. During actual construction, elastic wave equipment may be carried along with the drill to detect the distance between the drill bit and the coal pillar or collapse zone in real time, and dynamically correct the deviation in real time.

The purpose of forming the barrier wall is to protect the water-resistant coal pillar at the edge of the goaf, so the first grouting pressure is lower than the hydrostatic pressure at the grouting region corresponding to the first grouting operation. The operator checks the quality of the grouting by using underground exploratory drainage holes, etc., and if the stone formation rate of the water-cement mixture collected from the underground exploratory drainage holes is more than 80%, it can close the underground exploratory drainage holes and continue to maintain the first grouting pressure for 1 h to 2 h, the barrier wall is completed.

Operation 3: based on the observed water level from the probe holes, drawing isowater level lines using interpolation manners such as Surfer, etc. The drawdown funnels for each aquifer are identified, and the isowater level lines of each aquifer are superimposed to locate the groundwater decline pathways and windows (i.e., the lowest point of the water level). The skylight that has been identified is set as the final grouting area, and it is gradually polymerized and closed from its perimeter toward the skylight until the entire area is filled.

Because the barrier wall has been formed at the edge of the coal wall, the second grouting operation adopts a high-pressure splitting grouting scheme to split open the fissures within the grouting area as much as possible. The grouting pressure is the driving force to make the slurry overcome all kinds of resistance, so that the slurry fills and spreads in the rock fissures. The grouting pressure in the grouting process is simultaneously affected by various factors; therefore, in the construction process, necessary and reasonable adjustments should be made according to the actual situation to meet the quality requirements of grouting. The grouting pressure is related to the groundwater pressure, the fissure rate and fissure opening of the rock, the height of the grouting segment, and the ratio and performance of the slurry. The grouting pressure may be taken from the orifice pressure of the grouting hole; when the grouting pump is not far from the orifice of the grouting hole, or the resistance is not too great, the grouting pressure may be substituted with the pump pressure. The finalized grouting pressure may be designed based on the nature of the rock, hydrogeological feature, and empirical values, such as two to three times the hydrostatic pressure at the grouting region.

In some embodiments, the grouting pressure may be calculated by the following equation (2):

$$p \geq \frac{2H\gamma}{100}(2\sim4) \tag{2}$$

where p is the grouting pressure, H is the burial depth, $\gamma$ is the cumulative capacity weight of the overlying rock layer, (2~4) is a range of grouting pressure adjustment coefficient. The burial depth may be a vertical depth at the grouting region relative to the surface or datum. The grouting pressure during construction may be adjusted according to the actual situation.

The selection and drilling of the second grouting hole may refer to the first grouting hole.

Finally, the second grouting operation is performed by grouting the second grouting hole.

The second grouting operation may play a guiding role from outside to inside; it can gradually squeeze the surge water of the goaf to flow inward and return to the aquifer, preventing it from spreading to the outside of the goaf, thereby reducing the dosage of slurry and improving the grouting effect; after the second grouting operation, a 12-hour waiting period for coagulation is observed, and if it meets the criteria for the end of grouting after the pressure-water testing (such as a sharp rise in pressure during the pressure-water testing or a steep and straight pressure-flow curve, etc.), grouting will continue until coagulation.

In some embodiments, the extraction information further includes a coal seam feature, hydrostatic pressure information, and a collapse zone feature. The processor may determine, based on the coal seam feature, the hydrostatic pressure information, the collapse zone feature, and a slurry curing parameter, a first grouting parameter corresponding to each of a plurality of first time points, and based on the first grouting parameter, control the plurality of low-pressure grouting pumps to perform the first grouting operation on each of the first branch holes to form the barrier wall. In response to determining that the stone formation rate of the water-cement mixture in the underground exploratory drainage hole meets a predetermined condition, the processor may determine a grouting maintenance time period based on the stone formation rate, the slurry curing parameter, and the coal seam feature, and control the plurality of low-pressure grouting pumps to perform grouting based on the first grouting parameter corresponding to a conditioned time point during the grouting maintenance time period.

The coal seam feature refers to data related to the physical or geological properties of the coal seam. In some embodiments, the coal seam feature may include, the compressive strength and tensile strength of the coal seam. The compressive strength refers to maximum pressure-bearing capacity of the coal seam in a vertical direction. The tensile strength refers to ultimate tensile capacity of the coal seam when subjected to tension.

The hydrostatic pressure information refers to static pressures of groundwater at different heights or locations in the aquifer in the goaf.

The collapse zone feature (also known as collapse zone morphology) may include a vertical height range of the collapse zone.

The slurry curing parameter refers to relevant parameters of the slurry from injection to the formation of solidified stones. In some embodiments, the slurry curing parameter may include a stone formation velocity and a stone density. The stone formation velocity refers to a time it takes for the slurry from injection to the formation of solidified stones. The stone density refers to a mass per unit volume of the stone body after the slurry has solidified.

In some embodiments, the processor may obtain the coal seam feature, the hydrostatic pressure information, the collapse zone feature, and the slurry curing paramete by inputting them after measurement by a technician, etc. For example, the technician determines the in-situ mechanical parameters of the coal seam by drilling an elastometer or the like, and then determines the compressive strength and the tensile strength of the coal seam based on the in-situ mechanical parameters, etc. As another example, the technician may obtain the static pressure of groundwater in real time through monitoring equipment (e.g., a piezoresistive manometer, etc.), and observe the vertical height range of the collapse zone through a fiber-optic borehole imager, etc. Furthermore, the technician may pre-bury a resistivity probe near the first grouting hole and determine whether the slurry is cured and the time consumed for the slurry to cure and form the stone body by the change in resistance of the resistivity probe. The technician may also obtain the stone density by measurement, such as by a densitometer.

In some embodiments, the processor may obtain extraction information and a slurry curing parameter corresponding to each of the plurality of first time points and determine, based on the extraction information and the slurry curing parameter corresponding to each of the first time points, a first grouting parameter corresponding to each of the plurality of first time points.

The first grouting parameter refers to a parameter associated with the first grouting operation. In some embodiments, the first grouting parameter may include first grouting pressures corresponding to the plurality of first grouting holes or first branch holes.

The first time point refers to a time point in the process of the first grouting operation. The process of the first grouting operation may be divided into a plurality of stages based on the plurality of first time points, and a first grouting parameter corresponding to each stage may be set, which may result in a smoother change of the first grouting pressure, a stronger barrier wall, and a shorter grouting time. In some embodiments, the first time point may be set by a technician based on historical experience.

In some embodiments, for each first time point, the processor may determine the first grouting parameter corresponding to the first time point, based on the coal seam feature, the hydrostatic pressure information, the collapse zone feature, and the slurry curing parameter corresponding to the first time point, through a first parameter model.

The first parameter model is a machine learning model, e.g., a Deep Neural Network (DNN) model or other customized model structure, etc., or any combination thereof.

In some embodiments, the first parameter model may be acquired by training in a plurality of ways. For example, the first parameter model may be obtained by training based on a plurality of first training samples with a first label using a gradient descent manner, etc. The first training samples may include a sample coal seam feature, sample hydrostatic pressure information, a sample collapse zone feature, and a sample slurry curing parameter. The first label includes an actual first grouting parameter corresponding to the first training sample.

In some embodiments, the processor may screen, based on historical data, a historical grouting process in which the grouting effect meets the expectation, and take a historical coal seam feature, historical hydrostatic pressure information, a historical collapse zone feature, and a historical slurry solidification parameter corresponding to the obtained historical grouting process as the first training sample, and take a first grouting parameter used in the historical grouting process as the first label. The effect of grouting meets the expectation may be that the coal seam is not damaged during the grouting process.

In some embodiments, the training process of the first parameter model includes that: the processor may input the first training sample into an initial first parameter model, construct a loss function based on the first grouting parameter outputted by the initial first parameter model, construct a loss function with the first label based on the iterations of the loss function to update the initial first parameter model, and when the loss function satisfies a training end condition, the first parameter model training is completed. The training end condition may include the loss function converging, the count of iterations reaching a threshold, or the like.

In some embodiments, the processor controls, based on the first grouting parameter corresponding to the plurality of first time points, the plurality of low-pressure grouting pumps to perform the first grouting operation on each of the first grouting holes or the first branch holes based on the first grouting pressure in the first grouting parameter to form the barrier wall. More descriptions regarding the first grouting operation may be found in FIG. 1 and relevant descriptions thereof.

In some embodiments, in response to determining that the stone formation rate of the water-cement mixture in the underground exploratory drainage hole meets a predetermined condition, the processor may determine a grouting maintenance time period based on the stone formation rate, and the stone density and the coal seam feature corresponding to the conditioned time point. The grouting maintenance time period refers to a length of time that the grouting continues in the first grouting operation.

The stone formation rate refers to a ratio of a volume of the stone body formed after the slurry solidified during the grouting process to a total volume of slurry injected. The stone formation rate may be obtained by inputting after measurement by the technician, etc.

The conditioned time point refers to a last first time point before the stone formation rate meets the predetermined condition.

The predetermined condition may include the stone formation rate not less than a stone formation rate threshold, or the like. The stone formation rate threshold may be set by a technician based on experience, such as 80%, or the like.

In some embodiments, in response to determining that the stone formation rate of the water-cement mixture in the underground exploratory drainage hole meets a predetermined condition, the processor may control the plurality of low-pressure grouting pumps to grout, during the grouting maintenance time period, based on the first grouting parameter corresponding to the conditioned time point.

In some embodiments, the processor may determine the grouting maintenance time period based on the stone formation rate, the slurry curing parameter, and the coal seam feature. For example, the processor may determine the grouting maintenance time period based on the stone formation rate, the stone density and the coal seam feature corresponding to the conditioned time point through a period prediction model.

The period prediction model may be a machine learning model, e.g., a regression model or other customized model structure, etc., or any combination thereof.

In some embodiments, the period prediction model may be obtained by training in a plurality of ways. For example, the period prediction model may be acquired by training based on a plurality of second training samples with a second label using a gradient descent manner, etc. The second training samples may include a sample stone formation rate, a sample stone density, and a sample coal seam feature. The second label may include an actual maintenance grouting time period corresponding to the second training sample.

In some embodiments, the processor may screen, based on the historical data, the historical grouting process in which the grouting effect meets the expectation, take a historical stone formation rate, a historical stone density, and a historical coal seam feature corresponding to the obtained historical grouting process as the second training sample, and take the actual grouting maintenance time period used in the historical grouting process as the second label.

The training manner of the period prediction model is similar to that of the first parameter model, and a description of the training manner of the period prediction model may be found in the description of the training manner of the first parameter model.

In some embodiments, the processor may determine a target thickness of the barrier wall based on the coal seam feature, the target grouting radius, the hydrostatic pressure information, the stone density, and the second grouting pressure, and determine the maintenance grouting time period based on the target thickness. More descriptions regarding the second grouting pressure and the target grouting radius may be found in FIG. 1 and relevant descriptions thereof.

The target thickness of the barrier wall refers to a final thickness that the barrier wall needs to be.

In some embodiments, the processor may construct a target feature vector based on the target grouting radius, the second grouting pressure, and the coal seam feature, the stone density, and the hydrostatic pressure information corresponding to the conditioned time point, retrieve a reference feature vector in a vector database that satisfies retrieval conditions, and determine a thickness corresponding to the reference feature vector as the target thickness of the barrier wall.

In some embodiments, the vector database may be preset based on historical data, including a plurality of reference feature vectors and a thickness corresponding to each reference feature vector. For example, the processor may construct the reference feature vectors based on the historical coal seam feature, the historical grout radius, the historical hydrostatic pressure information, the historical stone density, and the historical second grouting pressure during the historical grouting process, taking the historical grouting thickness of the barrier wall during the process as the thickness corresponding to the reference feature vector.

In some embodiments, the retrieval conditions may include the highest similarity among vectors. The similarity of the vectors is negatively correlated with a vector distance. The vector distance includes a Euclidean distance, etc.

In some embodiments, the processor may determine a reference grouting time period corresponding to the target thickness as a current maintenance grouting time period by querying a first preset table based on the target thickness.

In some embodiments, the first preset table may be preset based on historical data. For example, the processor may filter historical grouting processes in the historical data in which the grouting effect meets the expectation, count the thickness of the barrier wall corresponding to the obtained historical grouting process in the first pre-set table, and count the historical grouting process corresponding to the grouting maintenance time period as a reference grouting time period into the first preset table. If one thickness corresponds to a plurality of maintenance grouting time periods, the processor may determine an average of the plurality of maintenance grouting time periods as a reference grouting time period corresponding to the thickness.

Some embodiments of the present disclosure can more accurately determine the thickness of a suitable barrier wall based on data related to the grouting process and the goaf, effectively prevent excessive spreading of the slurry, improve the stability of the grouting pressure and the efficiency of the grouting, and ensure the effect of the grouting and the construction safety.

In some embodiments of the present disclosure, by introducing multi-dimensional data and determining different first grouting parameters at a plurality of first time points, the stability of the grouting pressure and the efficiency of the grouting can be improved during the grouting process, and thus sturdiness of the barrier wall is improved. At the same time, according to the data in the actual grouting process, a more accurate maintenance grouting time period can be determined, which in turn ensures the grouting effect.

In some embodiments, the processor may determine, based on the hydrostatic pressure at the grouting region corresponding to the second grouting operation, a rock fissure feature, and a height of a grouting segment, a second grouting parameter corresponding to each of the second time points, and control the plurality of high-pressure grouting pumps to perform grouting based on the second grouting parameter.

The grouting region corresponding to the second grouting operation may include the plurality of the second grouting holes or the second branch holes. The hydrostatic pressure at the grouting region may be obtained by the hydrostatic pressure information.

The rock fissure feature refers to a fissure feature of the rock surrounding the grouting hole. In some embodiments, the rock fissure feature may include a fissure rate of the rock, a fissure opening, or the like. The fracture ratio refers to a percentage of a volume of a rock body that is fractured in a unit volume of a rock body. The fracture opening refers to an average width of the fissure.

The height of the grouting segment refers to a range of heights of rock and soil layers that the slurry effectively fills or reinforces in the vertical direction.

In some embodiments, the rock fissure feature and the height of the grouting segment may be obtained by probing with a probing device (e.g., an elastic wave device).

The second time point refers to a time point in the second grouting operation. The process of the second grouting operation may be divided into a plurality of stages based on the plurality of second time points, and the second grouting parameter corresponding to each stage is set. The plurality of second time points are preset based on historical experience.

The second grouting parameter refers to a parameter associated with the second grouting operation. In some embodiments, the second grouting parameter may include second grouting pressures corresponding to the plurality of the second grouting holes or the second branch holes. In some embodiments, one second time point corresponds to one second grouting parameter.

In some embodiments, for each second time point, the processor may determine, based on the hydrostatic pressure at the grouting region corresponding to the second time point, the rock fissure feature, and the height of the grouting segment, the second grouting parameter corresponding to the second time point through a second parameter model.

The second parameter model may be a machine learning model, e.g., a Deep Neural Network (DNN) model or other customized model structures, etc., or any combination thereof.

In some embodiments, the second parameter model may be obtained by training in a plurality of ways. For example, the second parameter model may be acquired by training based on a plurality of third training samples with a third label, utilizing a gradient descent manner, etc. The third training samples may include a sample hydrostatic pressure, a sample rock fissure feature, and a sample height of the grouting segment. The third label may include an actual second grouting parameter corresponding to the third training sample.

In some embodiments, the processor may screen, based on the historical data, the historical grouting process in which the grouting effect meets the expectation, extract the hydrostatic pressure at the grouting region corresponding to the second grouting operation in the obtained historical grouting process as the sample hydrostatic pressure, and take the rock fissure feature and the height of the grouting segment in the historical grouting process as the sample rock fissure feature and the sample height of the grouting segment. The processor may use the second grouting parameter that was used during the historical grouting process as the third label.

The training manner of the second parameter model is similar to that of the first parameter model, and a description of the training manner of the second parameter model may be found in the description of the training manner of the first parameter model.

In some embodiments, inputs to the second parameter model may also include the target thickness of the barrier wall. When the inputs to the second parameter model include the target thickness of the barrier wall, the third training sample also includes a sample thickness. The sample thickness is obtained in a manner similar to that described above for the third training sample.

According to some embodiments of the present disclosure, when determining the second grouting parameter by using the second parameter model, the effect of the second grouting pressure on the barrier wall is taken into account, so that a more appropriate second grouting parameter can be obtained, and the barrier wall can be avoided from being destroyed by too much grouting pressure.

In some embodiments, the processor controls, based on the second grouting parameter corresponding to the plurality of second time points, the plurality of high-pressure grouting pumps to perform the second grouting operation based on the second grouting pressure in the grouting parameter for each of the second grouting holes or the second branch holes. More descriptions regarding the second grouting operation may be found in FIG. 1 and relevant descriptions.

According to some embodiments of the present disclosure, in the process of the second grouting operation, determining the second grouting parameters corresponding to the different stages and controlling the high-pressure grouting pump to perform the grouting can ensure that the amount of injected slurry and the second grouting pressure are matched with the corresponding geologic conditions, which can improve the grouting effect and construction safety, and also help to maintain the stability of the second grouting pressure to avoid construction problems caused by changes in geological conditions.

In some embodiments, the distribution information of isowater level lines may further include change information of the isowater level lines.

In some embodiments, the processor may determine, based on the change information, a local pressurization point corresponding to each of the second time points. The processor may also determine, based on the change information corresponding to the local pressurization point, an adjustment-required grouting hole, and a modified grouting pressure corresponding to the adjustment-required grouting hole, and control the plurality of high-pressure grouting pumps to perform grouting based on the adjustment-required grouting hole and the modified grouting pressure.

More descriptions regarding the distribution information of isowater level lines may be found in FIG. 1 and relevant descriptions The change information refers to data related to changes that have occurred in the isowater level lines. In some embodiments, the change information of the isowater level lines includes a difference in water level of a plurality of locations on the isowater level lines over a predetermined time period, etc. The predetermined time period may be set in advance based on historical experience.

The local pressurization point refers to a location where the grouting pressure needs to be increased.

In some embodiments, the processor may determine a local pressurization point corresponding to each second time point based on the change information. For example, for each second time point, the processor may determine, based on the change information, a return rate of the water level at the lowest point of the water level, and if the return rate of the water level does not satisfy a return rate condition, determine the lowest point of the water level as the local pressurization point. The return rate condition may include that the return rate of the water level is not less than a return rate threshold. The return rate threshold may be determined based on historical data. For example, the processor uses an average of return rates of the water level at the lowest point of the water level in the historical data as the return rate threshold.

As another example, the processor may determine continuous drop points in the surrounding area of the goaf based on the change information as local pressurization points. The continuous drop points refer to locations where the water level continues to drop for a time period that exceeds a drop time threshold.

The surrounding area of the goaf may include areas not directly grouted and/or groundwater distribution zones away from the grouted core area.

The drop time threshold may be determined based on historical data, for example, the processor may determine a plurality of historical grouting processes in terms of the length of time from the start of the second grouting operation to the time point at which the water level in the surrounding area of the goaf is no longer declining, and use an average of the plurality of lengths of time as the drop time threshold.

The adjustment-required grouting hole refers to a second grouting hole or a second branch hole where a second grouting pressure is to be adjusted.

The modified grouting pressure refers to an adjusted second grouting pressure.

In some embodiments, the processor may also determine the adjustment-required grouting hole and the modified grouting pressure corresponding to the adjustment-required grouting hole based on the change information corresponding to the local pressurization points. For example, the processor may identify, based on the change information corresponding to the local pressurization point, the second grouting hole or the second branch hole that is closest to the local pressurization point as the adjustment-required grouting hole.

As another example, the processor may query a second preset table based on the change information corresponding to the local pressurization point and a distance between the adjustment-required grouting hole and the local pressurization point, and determine a reference grouting pressure in the second preset table as the modified grouting pressure corresponding to the adjustment-required grouting hole.

In some embodiments, the second preset table may be preset based on historical data. For example, the processor may screen historical data for grouting processes in which the return rate of the water level at the lowest point of the water table satisfies the return rate condition (or there is no sustained point of decline in the surrounding area of the goaf, etc.) after grouting based on the correction of the grouting pressure to treat the adjusted grouting holes. The processor counts the obtained change information corresponding to the grouting process as well as the distance between the adjustment-required grouting hole and the local pressurization point into the second preset table, and counts the second grouting pressure corresponding to the grouting process as the reference grouting pressure into the second preset table.

In some embodiments of the present disclosure, by identifying a location where the grouting pressure needs to be locally increased and performing localized pressurized grouting, grouting pressures at a plurality of grouting regions can be flexibly adjusted to enhance grouting effectiveness and save the amount of consumed slurry.

It is noted that some embodiments of the present disclosure are described above. Other embodiments are within the scope of the appended claims. In some embodiments, the actions or steps documented in the claims can be performed in a different order than in the embodiments described above and still achieve the desired results. Alternatively, the processes depicted in the accompanying drawings do not necessarily require a particular order or consecutive sequences illustrated in order to achieve the desired results. In some implementations, multitasking and parallel processing are also possible or may be advantageous.

It should be understood by those of ordinary skill in the art to which it belongs that the discussion of any of the above embodiments is merely exemplary and is not intended to imply that the scope of the present disclosure (including the claims) is limited to these examples; combinations between the above embodiments or between technical features in different embodiments are also possible in the context of the present disclosure's ideas, and the steps may be realized in any order, and there exist many different aspects of different aspects of the present disclosure's embodiments, such as the ones above. other variations, which for the sake of brevity they are not provided in detail.

Additionally, to simplify the description and discussion, and so as not to make the embodiments of the present disclosure difficult to comprehend, well-known power/ground connections to other components may or may not be shown in the accompanying drawings provided. In addition, the apparatus may be shown in block diagram form in order to avoid making the embodiments of the present disclosure difficult to understand, and this also takes into account the fact that the details regarding the manner in which these block diagram apparatuses are to be implemented are highly dependent on the platform on which the embodiments of the present disclosure are to be implemented (i.e., they should be well within the understanding of a person skilled in the art). In the event that specific details are set forth to describe exemplary embodiments of the present disclosure, it will be apparent to those of skill in the art that embodiments of the present disclosure can be implemented without these specific details or with variations of these specific details. embodiments of the present disclosure can be implemented in the absence of these specific details or with variations of these specific details. These descriptions should therefore be considered illustrative and not limiting.

While the present disclosure has been described in conjunction with specific embodiments of the present disclosure, many of the substitutions, modifications, and variations of these embodiments will be apparent to a person of ordinary skill in the art in light of the foregoing description. The embodiments of the present disclosure are intended to encompass all such substitutions, modifications, and variations that fall within the broad scope of the appended claims. As such, any omissions, modifications, equivalent substitutions, improvements, and the like made within the spirit and principles of the embodiments of the present disclosure shall be included in the scope of protection of the present disclosure.

What is claimed is:

1. A method for grout injection repair and water retention in a goaf, comprising:

determining extraction information on the goaf and a coal seam;

forming a barrier wall through performing a first grouting operation at a side of the goaf near the coal seam based on the extraction information, including: determining a first cross-sectional pattern of the goaf based on the extraction information; forming, starting from the coal seam near a corner of the first cross-sectional pattern, a first trajectory line through extending along an edge of the first cross-sectional pattern into the goaf; wherein first trajectory lines corresponding to each corner of the first cross-sectional pattern connect to each other to form a first grouting pattern; and performing the first grouting operation according to the first grouting pattern to form the barrier wall, including:

controlling, at a ground area corresponding to a starting point of each of the first trajectory lines of the first grouting pattern, a drilling device to perform vertical drilling based on a vertical drilling parameter to obtain a plurality of first grouting holes; for each of the plurality of first grouting holes, controlling the drilling device to perform horizontal drilling along a first trajectory line corresponding to the first grouting hole based on a horizontal drilling parameter to obtain a plurality of first branch holes; controlling a plurality of low-pressure grouting pumps to perform the first grouting operation on each of the plurality of first branch holes based on a first grouting pressure to form the barrier wall; wherein a distance between the first trajectory line and an adjacent edge of the first cross-sectional pattern is less than or equal to a target grouting radius; and a distance between a starting point of the first trajectory line and an adjacent edge of the first cross-sectional pattern is greater than or equal to the target grouting radius;

performing a second grouting operation to complete a grout injection repair from outside to inside in the goaf based on the extraction information, including: determining a second cross-sectional pattern of the barrier wall and a lowest point of a water level in the goaf based on the extraction information; forming, starting from any corner of the second cross-sectional pattern, a second grouting pattern through spirally extending along an edge of the second cross-sectional pattern toward the lowest point of the water level; and performing the second grouting operation according to the second grouting pattern to complete the grout injection repair, including:

controlling, at a ground area corresponding to a corner of the second grouting pattern, the drilling device to perform vertical drilling based on the vertical drilling parameter to obtain a plurality of second grouting holes; controlling the drilling device to perform horizontal drilling on the plurality of second grouting holes along at least one second trajectory line based on the horizontal drilling parameter to obtain a plurality of second branch holes; controlling a plurality of high-pressure grouting pumps to perform the second grouting operation one by one on the plurality of second branch holes from outside to inside in the goaf based on a second grouting pressure to complete the grout injection repair; wherein the first grouting pressure of the first grouting operation is less than the second grouting pressure of the second grouting operation; the second grouting pattern includes a plurality of second trajectory lines connected end to end, and a distance between a plurality of second trajectory lines parallel to a same edge of the second cross-sectional pattern is less than or equal to two times the target grouting radius; and a distance between a second trajectory line located at an outermost portion of the second grouting pattern and an adjacent edge of the second cross-sectional pattern is less than or equal to the target grouting radius.

2. The method for grout injection repair and water retention in a goaf according to claim 1, wherein the extraction information includes location information of the goaf and the coal seam, and distribution information of isowater level lines in a mining area.

3. The method for grout injection repair and water retention in a goaf according to claim 1, wherein the first grouting pressure is less than a hydrostatic pressure at a grouting region corresponding to the first grouting operation; and the second grouting pressure is two to three times a hydrostatic pressure at a grouting region corresponding to the second grouting operation.

4. The method for grout injection repair and water retention in a goaf according to claim 1, further comprising:

selecting a plurality of points in a ground area corresponding to the goaf for drilling to obtain a plurality of test holes;

grouting each of the plurality of test holes and obtaining one or more slurry diffusion radii; and selecting a smallest slurry diffusion radius from the one or more slurry diffusion radii as the target grouting radius.

* * * * *